US008033651B2

(12) United States Patent
Tomizawa et al.

(10) Patent No.: US 8,033,651 B2
(45) Date of Patent: Oct. 11, 2011

(54) LIQUID EJECTION HEAD AND PRINTING APPARATUS

(75) Inventors: Keiji Tomizawa, Yokohama (JP); Ken Tsuchii, Sagamihara (JP); Shuichi Ide, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 406 days.

(21) Appl. No.: 12/325,633

(22) Filed: Dec. 1, 2008

(65) Prior Publication Data

US 2009/0153624 A1 Jun. 18, 2009

(30) Foreign Application Priority Data

Dec. 5, 2007 (JP) ..... 2007-315034

(51) Int. Cl.
*B41J 2/05* (2006.01)

(52) U.S. Cl. ..... 347/65; 347/56; 347/61; 347/66; 347/86

(58) Field of Classification Search ..... 347/56, 347/61, 65, 66
See application file for complete search history.

(56) References Cited

U.S. PATENT DOCUMENTS

| | | | | |
|---|---|---|---|---|
| 4,558,333 | A | 12/1985 | Sugitani et al. | |
| 6,660,175 | B2 | 12/2003 | Kawamura et al. | |
| 7,111,930 | B2 * | 9/2006 | Studer et al. | 347/86 |
| 2003/0117462 | A1 * | 6/2003 | Cleland et al. | 347/65 |

FOREIGN PATENT DOCUMENTS

| | | |
|---|---|---|
| JP | 58-8658 | 1/1983 |

* cited by examiner

*Primary Examiner* — Matthew Luu
*Assistant Examiner* — Brian J Goldberg
(74) *Attorney, Agent, or Firm* — Fitzpatrick, Cella, Harper & Scinto

(57) ABSTRACT

A reliable print head with improved reliability is less likely to be damaged by possible cavitation in ink inside a bubbling chamber. A plurality of ink supply paths through which the ink is supplied to the bubbling chamber are connected to the bubbling chamber. Communication positions where the plurality of ink supply paths communicate with the energy acting chamber are formed such that distances from a heater formation surface of the communication positions are different from each other along a direction orthogonal to the heater formation surface.

6 Claims, 11 Drawing Sheets

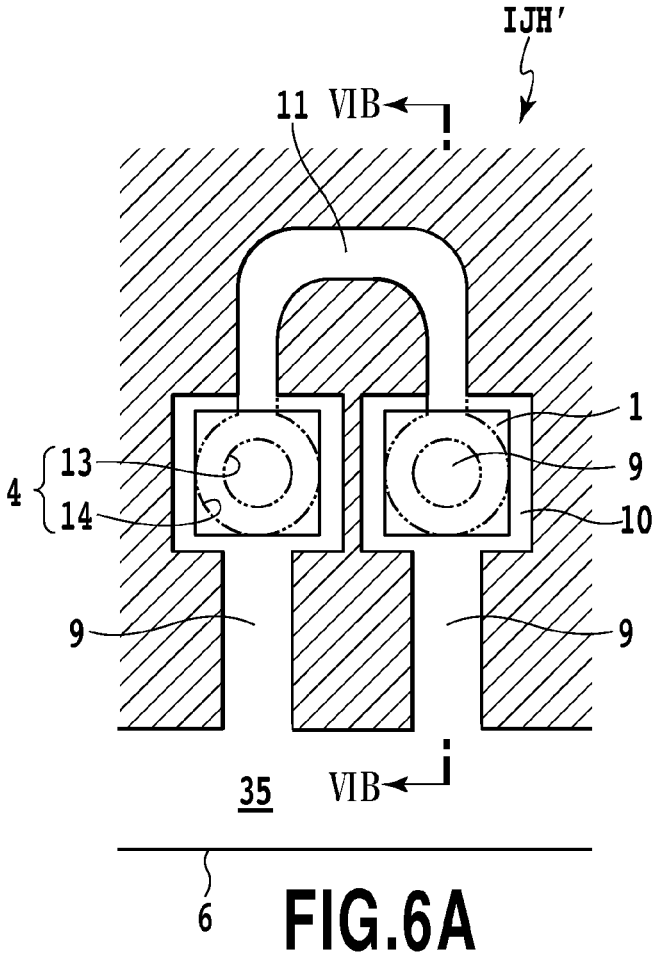
FIG.6A
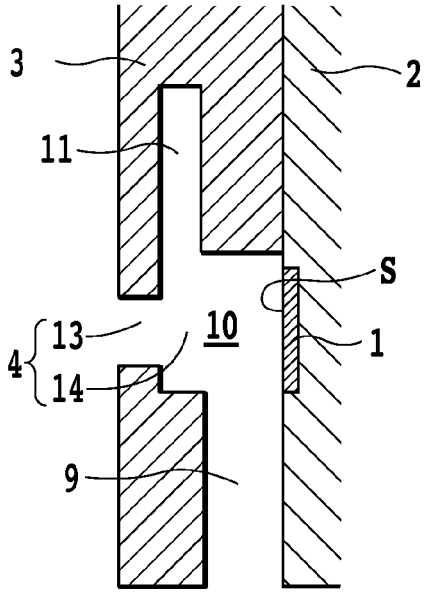
FIG.6B
FIG.6C
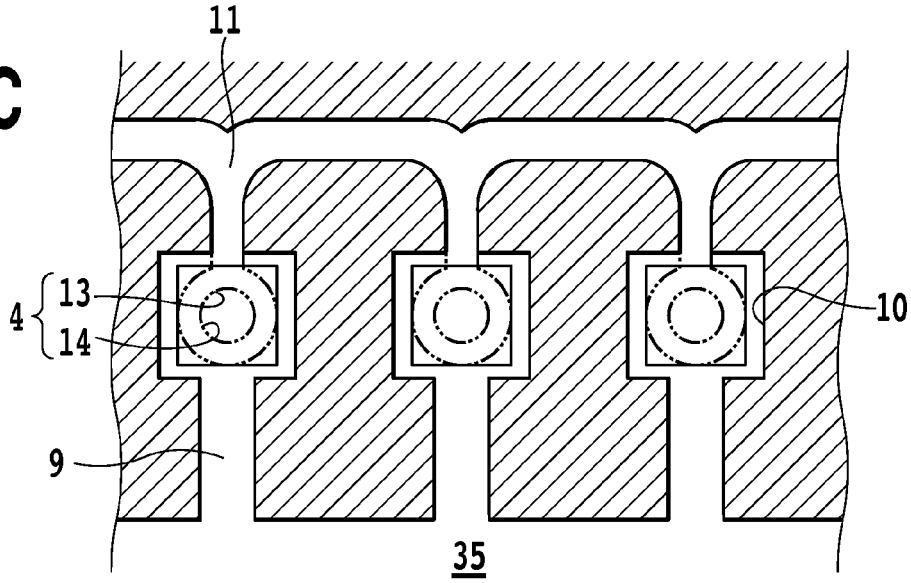

LIQUID EJECTION HEAD AND PRINTING APPARATUS

BACKGROUND OF THE INVENTION

1. Field of the Invention

The present invention relates to a liquid ejection head that ejects a liquid to a print medium for printing, and a printing apparatus using the liquid ejection head.

2. Description of the Related Art

In recent years, many printing apparatuses have been used, and for the printing apparatuses, there has been a demand for an increase in printing speed and resolution, an improvement in image quality, and a reduction in noise. An ink jet printing apparatus meets this demand. The ink jet printing apparatus is configured to eject ink droplets through ejection ports formed in a print head as a liquid ejection head to attach the ink droplets to a print medium for printing.

Some ink jet printing apparatuses commonly used adopt a method of ejecting ink droplets using electrothermal transducing elements (heating elements) such as heaters as ejection energy generating elements to eject ink droplets. The method uses the ejection energy generating elements to generate bubbles in ink so that the resulting bubbling pressure allows the ink droplets to be ejected. That is, a voltage is applied to the electrothermal transducing elements to instantaneously boil the ink in the vicinity of the electrothermal transducing elements. Then, the phase-change of the ink occurs to rapidly generate a bubbling pressure to eject the ink droplets at a high speed. This method enables the ejection of the ink droplets to be precisely controlled using electric signals. As a result, an ink jet printing apparatus can be provided which can accurately eject the ink droplets. Furthermore, advantageously, the ink ejecting method using the electrothermal transducing elements, for example, eliminates the need for a large space in which the ejection energy generating elements are disposed, simplifies the structure of the print head, and facilitates integration of nozzles. Therefore, the use of such an ink jet printing apparatus enables letters, images, and the like to be densely printed with a high definition.

Some print heads for the above-described ink jet printing apparatuses are of a type in which a plurality of ink channels communicate with one bubbling chamber as an energy acting chamber as disclosed in U.S. Pat. No. 6,660,175 and Japanese Patent Application Laid-Open No. S58-8658 (1983). In these print heads, two symmetric ink flows flow into an area on each heating element through respective ink channels communicating with the space on the heating element. Then, the heating element is driven to generate bubbles in the ink on the heating element to allow the ink to be ejected through the ejection ports.

However, in the print head ejecting the ink by generating the bubbles, cavitation may occur during debubbling inside the print head. The cavitation rapidly varies the pressure inside the bubbling chamber, which can damage the electrothermal transducing elements. In particular, when such a rapid, repeated pressure variation concentrates at one fixed position inside the ink stored in the print head, a repeated impact is applied to surroundings of the position. This may damage a part of the wall surfaces inside the print head or some of the electrothermal transducing elements. For example, when the rapid pressure variation causes a repeated impact to the electrothermal transducing elements, surfaces of the electrothermal transducing elements may be scraped. Furthermore, depending on the position of the cavitation, wires through which electricity is transmitted may be broken, thereby preventing the electrothermal transducing elements from being driven.

SUMMARY OF THE INVENTION

In view of the above-described circumstances, an object of the present invention is to use a configuration of a liquid ejection head in which a plurality of liquid channels communicate with an energy acting chamber, to inhibit the interior of the liquid ejection head from being damaged by possible cavitation in a liquid inside the energy acting chamber. Another object of the present invention is to provide a reliable liquid ejection head with durability improved by the above-described configuration, as well as a printing apparatus using the liquid ejection head.

In a first aspect of the present invention, there is provided a liquid ejection head comprising: a substrate; a heating element disposed on the substrate to generate heat energy utilized to eject a liquid; an energy acting chamber partly defined by the substrate and in which the heating element is disposed; and an ejection port portion provided opposite the heating element to eject the liquid contained in the energy acting chamber to which the heat energy is applied by the heating element, wherein a plurality of liquid supply paths through which the liquid is supplied to the energy acting chamber are connected to the energy acting chamber, and communication positions where the plurality of liquid supply paths communicate with the energy acting chamber are formed such that distances from a heating element formation surface to each of the communication positions are different from each other along a direction orthogonal to the heating element formation surface.

In a second aspect of the present invention, there is provided a printing apparatus performing printing using a liquid ejection head comprising: a substrate; a heating element disposed on the substrate to generate heat energy utilized to eject a liquid; an energy acting chamber partly defined by the substrate and in which the heating element is disposed; and an ejection port portion provided opposite the heating element to eject the liquid contained in the energy acting chamber to which the heat energy is applied by the heating element, wherein a plurality of liquid supply paths through which the liquid is supplied to the energy acting chamber are connected to the energy acting chamber, and communication positions where the plurality of liquid supply paths communicate with the energy acting chamber are formed such that distances from a heating element formation surface to each of the communication positions are different from each other along a direction orthogonal to the heating element formation surface.

According to the liquid ejection head of the present invention, the plurality of communication positions where the plurality of liquid supply paths communicate with the energy acting chamber are formed such that the distances from the heating element forming surface to each of the communication positions are different from each other along the direction crossing the heating element forming surface. Thus, the liquid flowing into the energy acting chamber forms a whirling flow. The generated whirling flow pushes bubbles generated by the heating element to disperse a debubbling position of the bubbles, thus inhibiting debubbling from concentrating at a fixed position. Consequently, an impact caused by possible cavitation during debubbling is dispersed to improve the durability of the heating elements and thus the durability of the liquid ejection head. Furthermore, in the printing apparatus using the liquid ejection head, the number of times the liquid ejection head needs to be replaced is reduced, thus reducing maintenance costs of the printing apparatus.

Further features of the present invention will become apparent from the following description of exemplary embodiments (with reference to the attached drawings).

BRIEF DESCRIPTION OF THE DRAWINGS

FIG. 6A is an enlarged sectional view of an essential part of a print head according to a second embodiment of the present invention as viewed in the ejection direction, FIG. 6B is a sectional view of the essential part taken along line VIB-VIB in FIG. 6A, and FIG. 6C is a sectional view of another example of the second embodiment as viewed in the ejection direction;

DESCRIPTION OF THE EMBODIMENTS

First Embodiment

A first embodiment for implementing the present invention will be described below with reference to the accompanying drawings.

General Configuration of the Printing Apparatus

Figure 1:
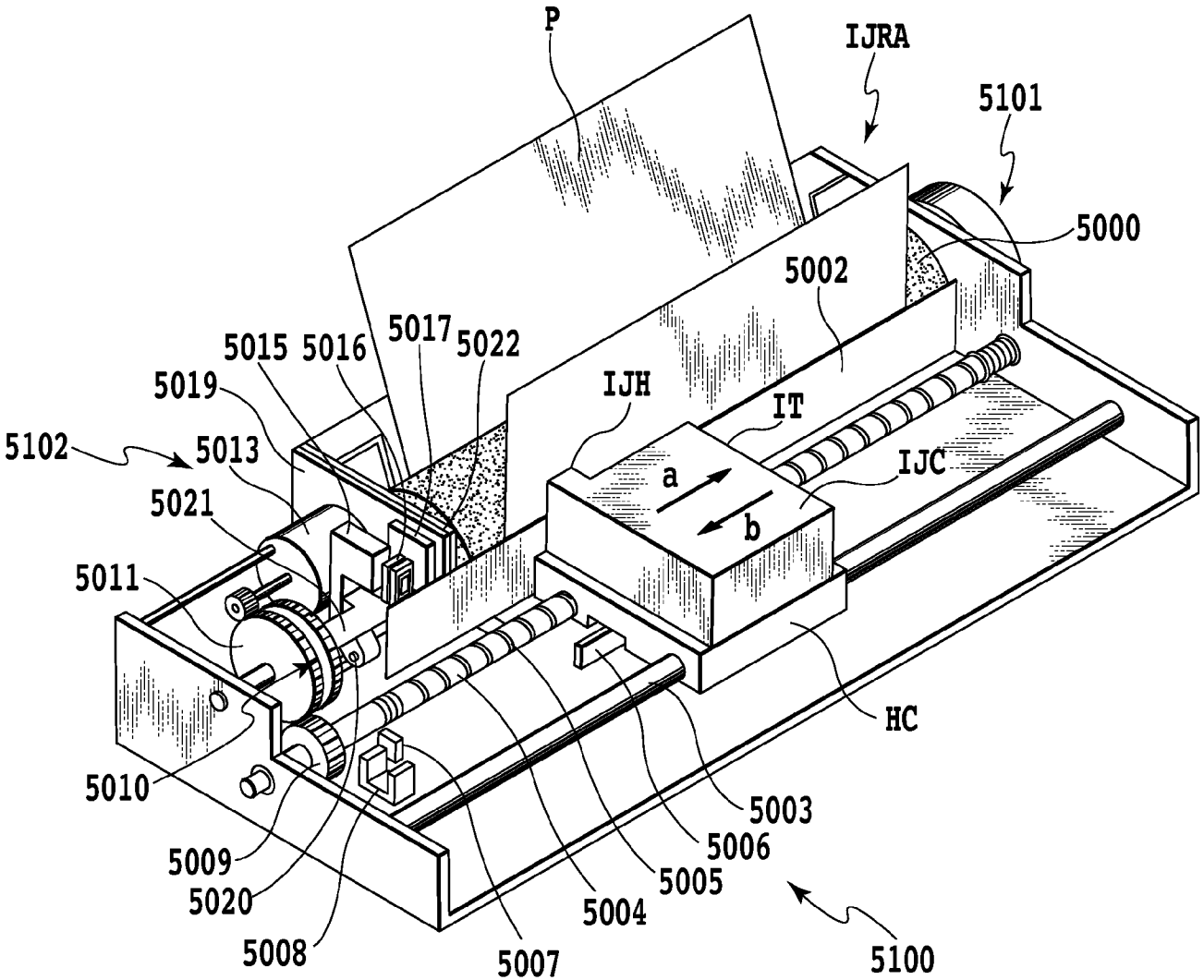
FIG. 1 is a perspective view of a printing apparatus using a print head according to a first embodiment of the present invention, with a cover removed therefrom.

FIG. 1 is a perspective view of an ink jet printing apparatus IJRA as a printing apparatus using a print head IJH as a liquid ejection head according to the present invention, with a cover removed from the ink jet printing apparatus IJRA. The ink jet printing apparatus IJRA includes the print head IJH, a scanning mechanism 5100 allowing the print head IJH to perform scanning, a conveying mechanism 5101 that conveys a print medium P, and a recovery mechanism 5102 that recovers the print head IJH.

In the present embodiment, the print head IJH and an ink tank IT in which ink is stored are integrally formed into an ink jet cartridge IJC. The ink jet cartridge IJC is located so as to be mounted on a carriage HC.

A scanning mechanism 5100 includes a driving motor 5013 such that a driving force of the driving motor 5013 is transmitted to a lead screw 5004 via driving force transmitting gears 5009, 5010, and 5011 to rotate the lead screw 5004. The lead screw 5004 includes a spiral groove 5005 formed all over an outer periphery thereof in a direction in which the lead screw 5004 extends. The lead screw 5004 is located so as to penetrate the carriage HC and engages, inside the carriage HC, with a spiral groove (not shown in the drawings) formed in the carriage. Thus, the lead screw 5004 rotates to allow the carriage HC to be placed in engagement with the spiral groove 5005 to perform scanning. Furthermore, a guide rail 5003 along which the moving carriage HC is guided is located so as to penetrate the carriage HC. Consequently, the carriage HC performs scanning in a direction in which the guide rail 5003 extends as shown by arrows (a) and (b) in FIG. 1. Photo couplers 5007 and 5008 are position sensors that check whether or not a lever 5006 of the carriage is present in a corresponding area to, for example, switch a rotating direction of the motor 5013.

A print medium P onto which ink as a liquid is ejected by the print head IJH is mounted in the conveying mechanism 5101. A presser plate 5002 presses the print medium P on a platen 5000 in order to maintain an appropriate distance between the print medium P and the print head IJH.

The recovery mechanism 5102 enables a suction recovery operation to be performed on the print head IJH by sucking ink from the interior of the print head IJH. The recovery mechanism 5102 includes a cap member 5022 and a suction member 5015. For the suction recovery operation, the cap member 5022 caps an ejection port surface of the print head IJH. A support member 5016 supports the cap member 5022. The suction member 5015 performs suction on the interior of the cap to suck the ink from the interior of the print head via an in-cap opening 5023. Reference numeral 5021 denotes a lever used to start the suction for the suction recovery operation. The recovery mechanism 5102 is located such that rotation of the lead screw 5005 associated with movement of the carriage HC is transmitted to a cam 5020, which then rotates to allow the suction recovery operation to be performed. In this case, the driving force of the motor moving the carriage HC is transmitted to the cam 5020 via a well-known transmission mechanism such as clutch switching, to control the rotation of the cam 5020.

The recovery mechanism 5012 includes a cleaning blade 5017. Reference numeral 5019 denotes a member that enables the cleaning blade 5017 to be reciprocated in the directions of arrows (a) and (b) in FIG. 1. Wiping by reciprocating the cleaning blade 5017 in abutment with the ejection surface of the print head IJH allows thickened ink, dust and dirt, and the like on the ejection port formation surface of the print head IJH to be wiped off. The cleaning blade 5017 is not limited to the present embodiment, and another well-known cleaning blade may be used.

The present embodiment is configured such that for the capping, the suction recovery, and the cleaning, desired processes are carried out at respective positions corresponding to a home position of the carriage HC when the carriage HC is in a given area on the home position side. However, various recovery operations may be performed while the carriage HC is not on the home position side.

Description of the Control Arrangement

Now, a control arrangement for performing printing control on the above-described apparatus will be described.

Figure 2:
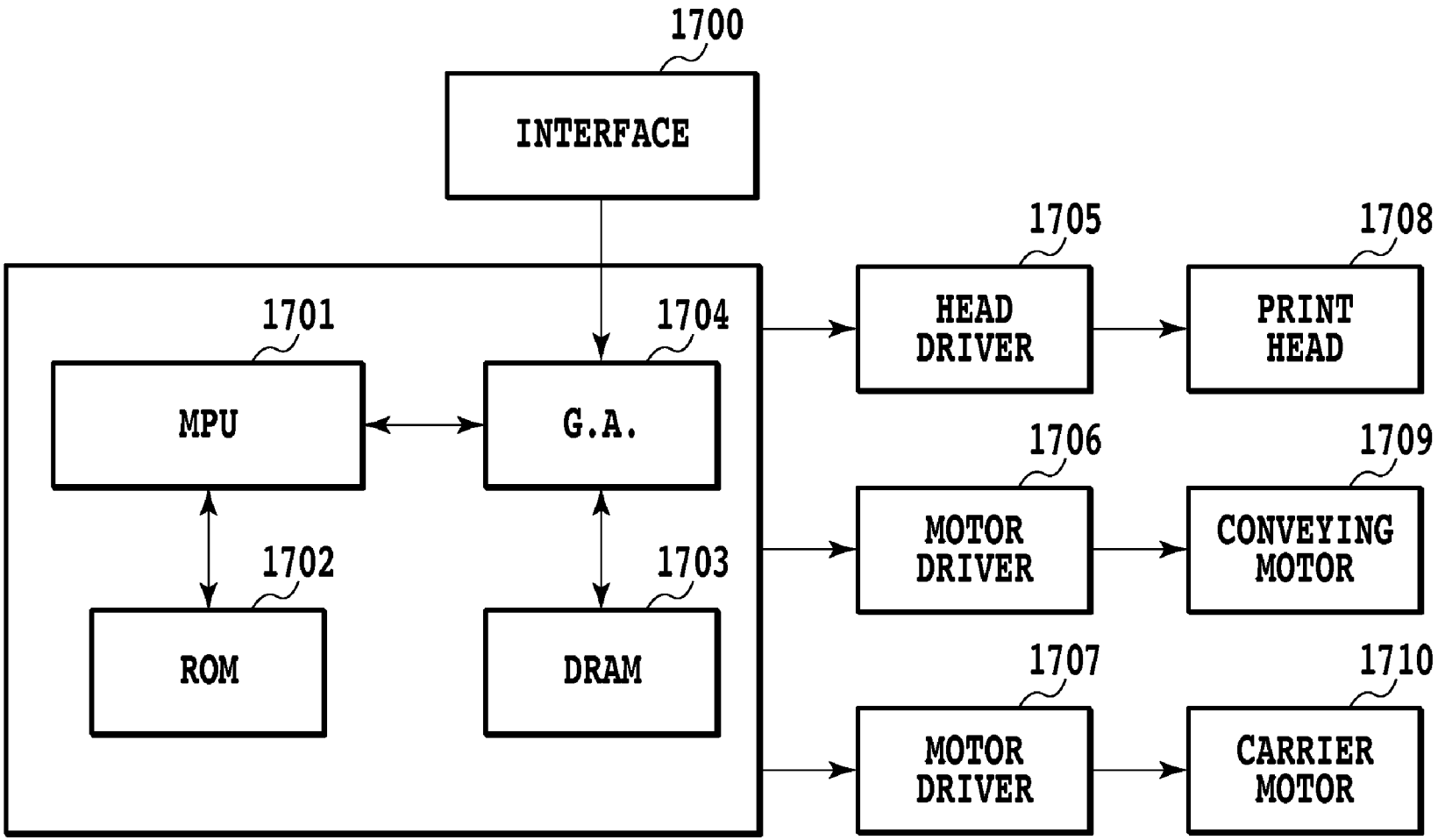
FIG. 2 is a block diagram showing a flow of data and an electric signal in the printing apparatus in FIG. 1.

FIG. 2 is a block diagram showing a configuration of a circuit that controls the ink jet printer IJRA. The block diagram in FIG. 2 shows a flow of data in the printing apparatus IJRA. The printing apparatus IJRA includes an interface 1700, a MPU 1701, a ROM 1702, and a DRAM 1703. For printing, first, the interface 1700 inputs a print signal to the printing apparatus IJRA. The MPU 1701 executes control programs. The control programs executed by the MPU 1701 are stored in the ROM 1702. The print signal and various data such as print data to be supplied to the print head IJH are saved to the DRAM 1703.

The printing apparatus IJRA includes a gate array (G. A.) 1704 that controls supply of the print data to the print head IJH. The gate array 1704 also controls data transfers between the interface 1700 and the MPU 1701 and the DRAM 1703. The printing apparatus IJRA includes a carrier motor 1710, a conveying motor 1709, a head driver 1705, and motor drivers 1706 and 1707. The carrier motor 1710 drives the print head IJH carried by the carriage HC during scanning. The conveying motor 1709 performs driving for conveying the print medium P. The head driver 1705 drives the print head IJH. The motor drivers 1706 and 1707 drive the conveying motor 1709 and the carrier motor 1710.

A printing operation performed by the above-described control arrangement will be described. Upon entering the interface 1700, the print signal is converted, between the gate array 1704 and the MPU 1701, into print data for printing which is applicable to the printing apparatus IJRA. Then, the motor drivers 1706 and 1707 are driven, and the print head IJH is driven via the carriage according to the print data sent to the head driver 1705. Thus, printing is performed.

Description of the Print Head

Figure 3:
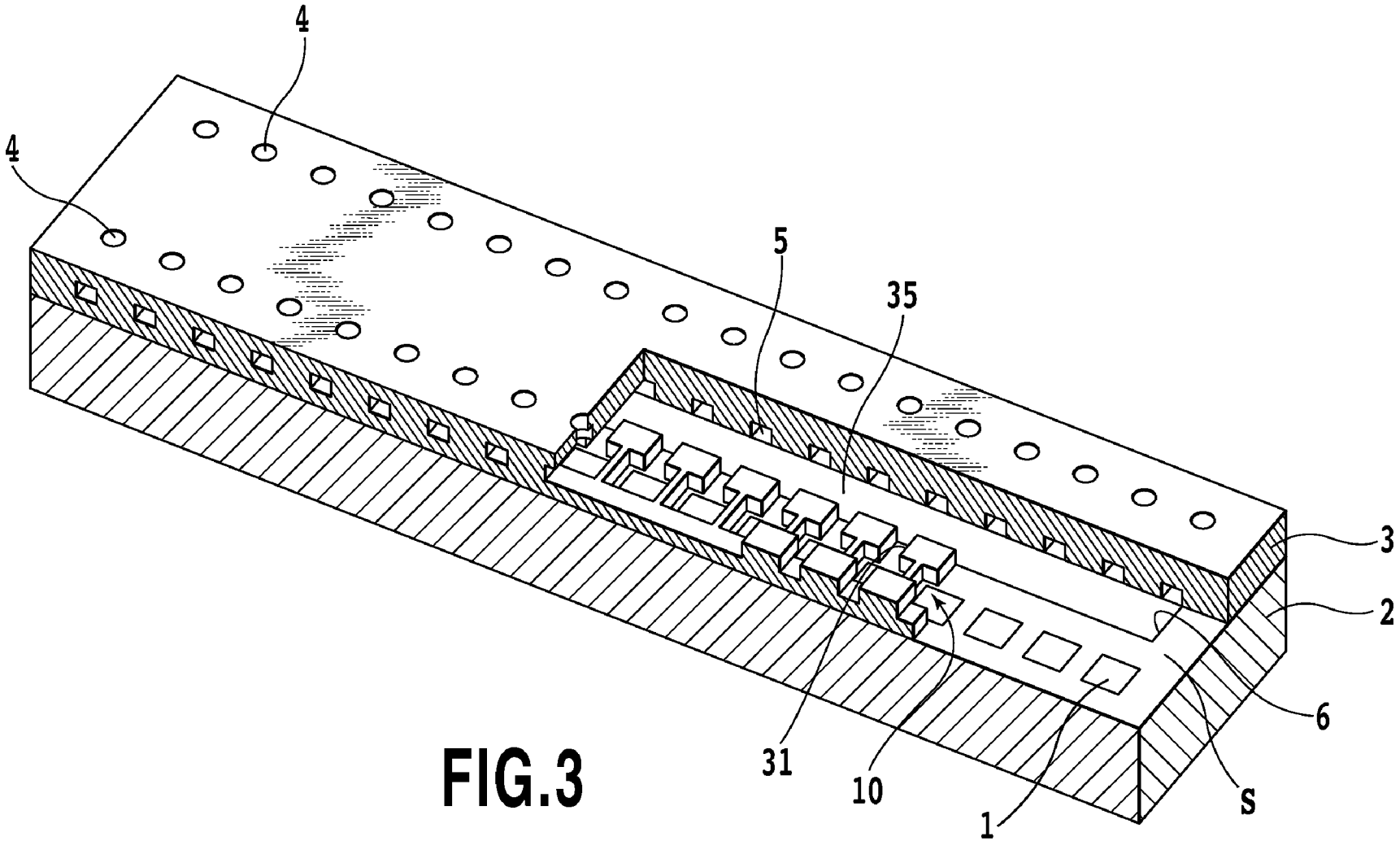
FIG. 3 is an enlarged and partly exploded perspective view of an essential part of the print head used in the printing apparatus in FIG. 1.

Now, the print head IJH as an ink jet print head according to the present embodiment will be described. FIG. 3 shows a partly exploded sectional view of the print head IJH according to the present embodiment. The print head IJH includes an element substrate 2 as a substrate on which heaters 1 as heating elements allowing ink to be ejected are provided, and an orifice plate (channel constituting substrate) 3 joined to the element substrate 2. The orifice plate 3 has a plurality of ejection port portions 4 through which ink droplets are ejected. The orifice plate 3 is joined to the element substrate 2 to form bubbling chambers 10 and ink channel 30, and allows the ejection port portions 4 to communicate with the respective bubbling chambers 10 which serve as energy acting chambers, and ink channels 30 to communicate with the bubbling chambers 10. A common liquid chamber 35 is also defined in which ink fed through an ink supply port 6 is stored and distributed to respective ink channels. The ejection port portion 4, the bubbling chamber 10, and the ink channel 30 are collectively referred to as a nozzle 5. In the present embodiment, two rows of ejection ports are formed across the one ink supply port 6 and are staggered. An isolating wall 31 is formed to allow adjacent nozzles 5 to be individually formed independently of each other. The isolating wall 31 is extended from the ejection port portion 4 to the vicinity of the ink supply port 6. The heater 1 is buried in the element substrate 2, which belongs to walls defining an internal space of the bubbling chamber 10. The heater 1 is driven to generate bubbles inside the bubbling chamber 10 so that the resulting bubbling pressure allows the ink to be ejected through the ejection port portion 4. The ink supply port 6 is formed in the element substrate 2, and penetrates the element substrate 2 from a front surface contacting the orifice plate 3 to an opposite, back surface. In the present embodiment, the ejection port portion 4 includes a first ejection port portion 13 that communicates with atmosphere, and a second ejection port portion 14 which has a larger sectional area than the first ejection port portion 13 in a direction orthogonal to an ejection direction and which is formed between the bubbling chamber 10 and the first ejection port portion 13.

Here, the element substrate 2 is generally formed of Si (silicon) and may otherwise be formed of, for example, glass, ceramics, resin, or metal. The heaters 1, electrodes (not shown in the drawings), and wires in a predetermined wiring pattern are provided on a surface of the element substrate 2 for the respective ink channels; the electrodes apply a voltage to the heaters 1, and the wires (not shown in the drawings) are connected to the electrodes. An insulating film (not shown in the drawings) is also provided on the surface of the element substrate 2 and over the heaters 1 in order to improve diffusion of stored heat. A protect film (not shown in the drawings) is also provided on the surface of the element substrate 2 and over the insulating film in order to protect the element substrate 2 from possible cavitation, to be described below, during debubbling. The orifice plate 3, which forms a front surface side of the nozzles, is formed of, for example, metal, polyimide, polysulfone, or an epoxy resin. Here, the surface of a part of the heater 1 which faces the bubbling chamber 10 is defined as a heater formation surface S or as a heating element formation surface. In the present embodiment, the surface of the part of the heater 1 which faces the bubbling chamber 10 is formed flush with the surface of the element substrate 2. The heater formation surface S may project from the surface of the element substrate 2 in the ejection direction. In this case, the heater formation surface S is the surface of a part of the heater 1 projecting in the ejection direction which faces the bubbling chamber 10. If the heater 1 is buried in the element substrate 2 to some degree, the heater formation surface S is the surface of a part of the element substrate 2 in the area between the heater 1 and the bubbling substrate 10 which faces the bubbling chamber 1.

Figure 4A:
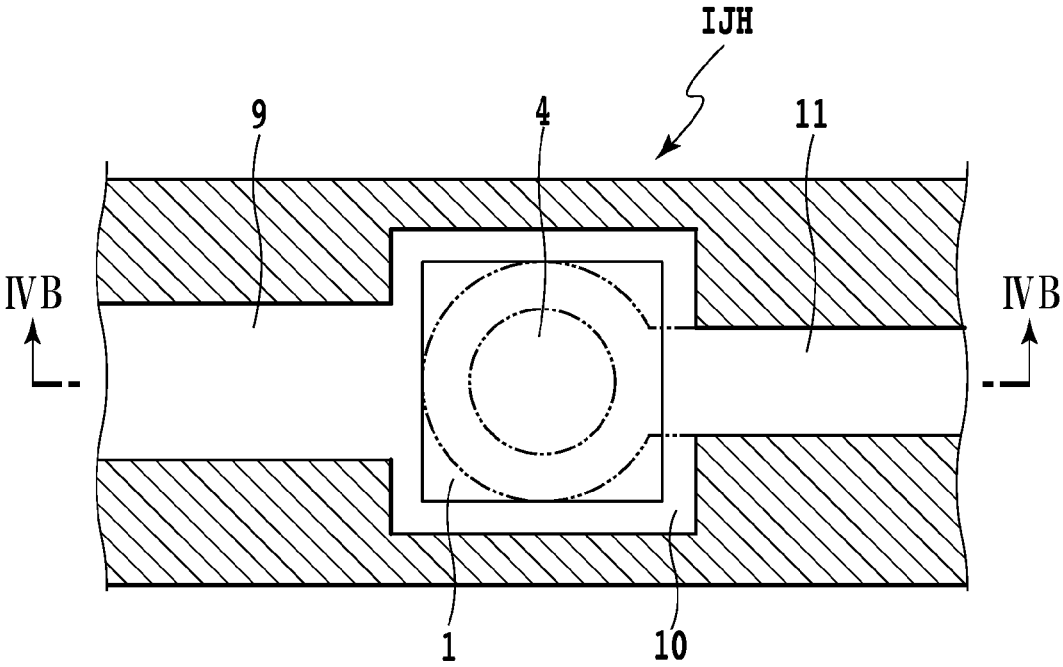
FIG. 4A is an enlarged sectional view of the essential part of the print head in FIG. 3 as viewed in an ejection direction.
Figure 4B:
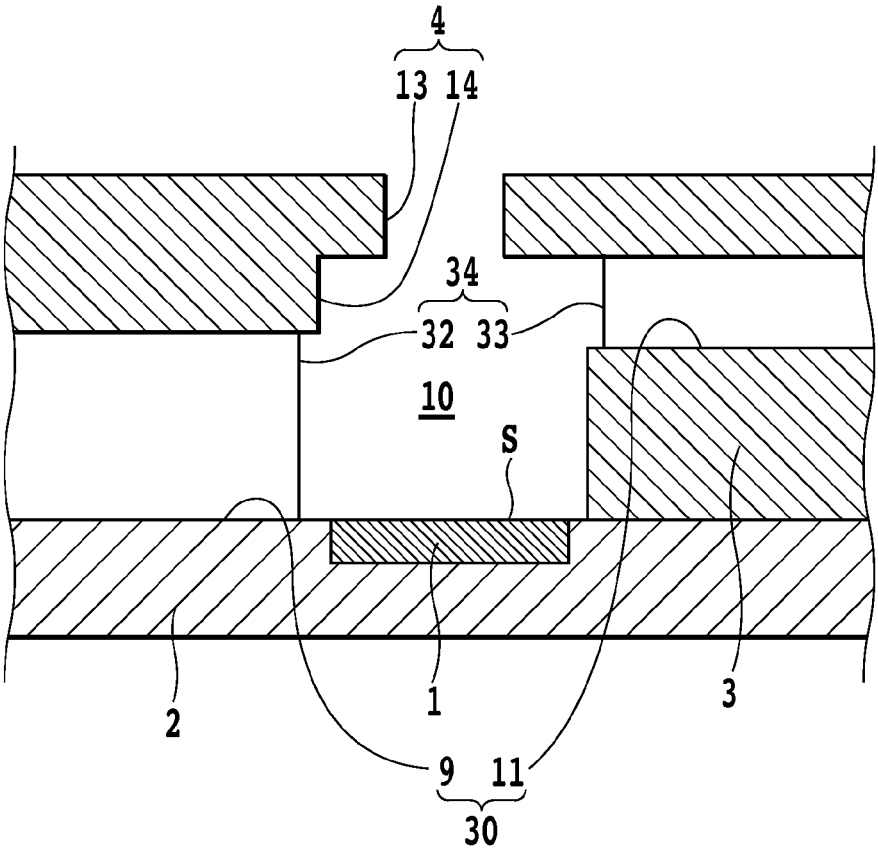
FIG. 4B is a sectional view of the essential part taken along line IVB-IVB in FIG. 4A.

FIGS. 4A and 4B are an enlarged sectional view of an essential part of one of the nozzles 5 in the print head IJH according to the present embodiment as viewed from the ejection direction, and an enlarged sectional view of the nozzle as viewed from a side surface of the print head IJH. FIG. 4A is a sectional view of a part of the essential part of the print head IJH as viewed from the ejection direction as an ink ejection direction which is perpendicular to the element substrate 2. FIG. 4B is a sectional view taken along line IVB-IVB in FIG. 4A. A plurality of the ink supply paths 30, through which ink is supplied, is connected to the bubbling chamber 10, in the nozzle 5 in the print head IJH, used in the present embodiment. A communication position 34, where each of the plurality of ink supply paths 30 communicates with the bubbling chamber 10, is formed to vary in a distance from the heater formation surface S along a direction crossing the heater formation surface S.

In the present embodiment, in particular, the two ink supply paths 30 communicate with the bubbling chamber 10. The two communication positions 32 and 33 between the ink supply paths 30 and the bubbling chamber 10 differ in the distance from the heater formation surface S and the surface of the element substrate 2. In the present embodiment, in particular, when the bubbling chamber 10 is viewed in the ejection direction, the two ink supply paths 30 extend, at the communication positions, in a direction in which the ink supply paths 30 lie opposite each other across the bubbling chamber 10.

In the present embodiment, the ink supply path closer to the element substrate 2 is defined as a substrate-side supply path 9. The ink supply path farther from the element substrate 2 is defined as a substrate far-side supply path 11. Thus, the substrate-side supply path 9 and the substrate far-side supply path 11 communicate with the respective bubbling chamber 10 at the respective positions located at the different distances from the heater formation surface S. The ink supply paths 9 and 11 are formed opposite each other. Here, the bubbling chamber 10, the substrate-side supply path 9, and the substrate far-side supply path 11 are formed between the adjacent common liquid chambers 35. One end of each of the ink supply paths 30 communicates with the corresponding bubbling chamber 10. The other end of each of the ink supply paths 30 communicates with the common liquid chamber 35. Consequently, ink is supplied to and refilled into the bubbling chamber 10 through both ink supply ports 6 located adjacent to each other across the bubbling chamber 10. Furthermore, in the present embodiment, the substrate far-side supply path 11 communicates with the second ejection port portion 14.

Here, the distance from the heater formation surface S (heating element formation surface) to the ink supply path refers to the distance between the heater formation surface and the center of a cross section of the ink supply path, at the communication position where the ink supply path communicates with the corresponding bubbling chamber 10. The center of the cross section of the ink supply path refers to the center of area (center of gravity) of the cross section of the ink supply path.

Now, ejecting operation of ink from the print head IJH according to the present embodiment will be described.

For printing, after the ink stored in the ink tank IT is supplied to and filled in the print head IJH, an electric signal is transmitted to the heater 1. The heater 1 is thus driven to generate heat to supply heat energy to the ink stored around the periphery of the heater 1, located inside the bubbling chamber 10 of the print head IJH. When the ink around the periphery of the heater 1 is heated, film boiling occurs to generate bubbles inside the bubbling chamber 10. The generated bubbles raise the pressure inside the bubbling chamber 10, and push the ink out of the bubbling chamber 10 to eject the ink to the print medium P via the ejection port portion 4. When the ink is ejected, new ink corresponding to the ink consumed by the ejection is supplied to the bubbling chamber 10 via the ink supply paths 30 in order to fill the interior of the bubbling chamber 10 with the ink.

In the present embodiment, the two ink supply paths 30, the substrate-side supply path 9 and the substrate far-side supply path 11, communicate with the bubbling chamber 10. Thus, the ink is supplied to the bubbling chamber 10 through both ink supply paths, the substrate-side supply path 9 and the substrate far-side supply path 11. In this case, the distance from the heater formation surface S to the substrate-side supply path 9 is different from that from the heater formation surface S to the substrate far-side supply path 11. Furthermore, opposite flows of ink through the ink supply paths 9 and 11 are supplied to the bubbling chamber 10. Thus, a whirling ink flow occurs inside the bubbling chamber 10. Consequently, the whirling flow pushes the bubbles over the heater 1 to prevent the bubbles from remaining at a fixed position inside the bubbling chamber 10. Since the bubbles are prevented from remaining at a fixed position inside the bubbling chamber 10, a position where the bubbles disappear inside the bubbling chamber 10 also varies.

Upon disappearing, the generated bubbles collapse inside the bubbling chamber 10, causing a rapid pressure variation at the debubbling position. This impacts inner walls of the bubbling chamber 10 and the heaters 1. If the debubbling position is fixed inside the bubbling chamber 10, the same area maybe repeatedly impacted to damage surroundings of the debubbling position. However, the print head IJH according to the present embodiment, the whirling flow occurring inside the bubbling chamber 10 prevents the debubbling position of the bubbles from being fixed. This inhibits the impact of the debubbling from concentrating at one position.

Dispersion of the position impacted by the debubbling inhibits the same area from being repeatedly impacted. This enables prevention of deformation of the interior of the bubbling chamber 10 in the print head IJH and deformation of the surface of the heaters 1. Thus, a possible resulting decrease in ejection speed and possible resulting disconnection of the heaters 1 can be prevented, correspondingly enabling improvement of the durability of the print head IJH. Furthermore, in the printing apparatus IJRA, which uses the print head IJH, the number of times that the print head IJH is replaced is reduced, thus reducing maintenance costs of the printing apparatus IJRA.

Figure 5:
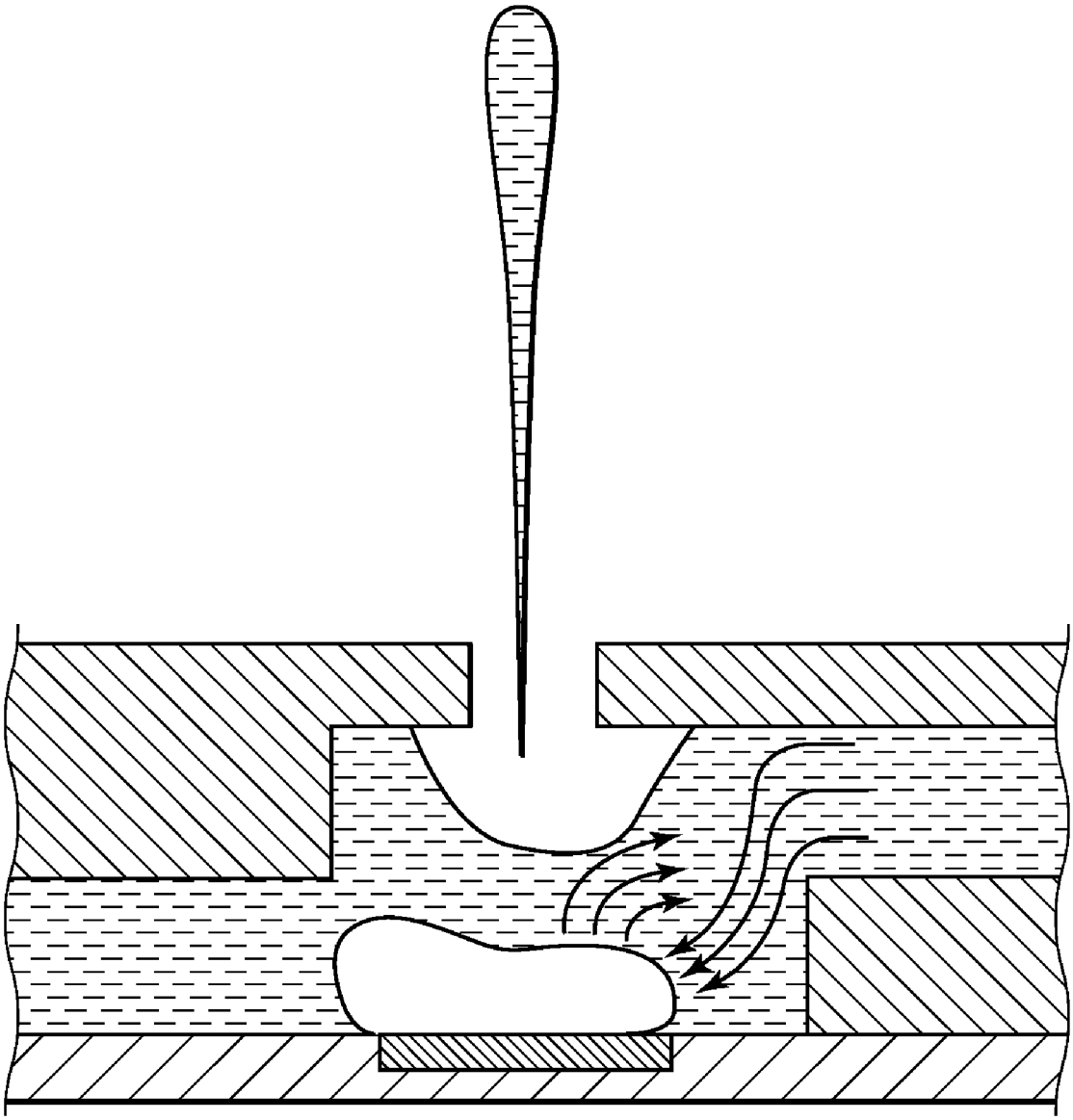
FIG. 5 shows results of calculation based on computational experiments on a flow of ink inside each supply path observed when ink is ejected from the print head, which is then refilled with ink during debubbling.

To confirm the above-described effects, assuming the same nozzle arrangement according to the present embodiment, computational experiments were performed on the flow of ink in each supply path observed when ink was refilled during debubbling. The results of the experiments are shown in FIG. 5. FIG. 5 shows the same arrangement as that in a sectional view of the nozzle 5 in FIG. 4B taken along line IVB-IVB in FIG. 4A according to the first embodiment in FIGS. 4A, 4B. The flow of ink during the debubbling is shown by an arrow. The size of the nozzle used for the computation is as follows. The ejection port portion was shaped like a circle with a diameter of 8 μm, and the heater was shaped like a square 6.8 μm on a side. The bubbling chamber was 18 μm in a width direction (depth on the figure) and 30 μm in a longitudinal direction. The width of the substrate-side supply path and the substrate far-side supply path was set to 10 μm respectively, and the height of each supply path was set to 10 μm. The height of the bubbling chamber was set to 20 μm, and the thickness (height) of the ejection port portion was set to 5 μm respectively. The computational experiments were performed under these conditions. As shown in FIG. 5, the results of the computational experiments indicate that the ink flowing through the substrate-side supply path and the ink flowing through the substrate far-side supply path flow into the bubbling chamber 10 at the different positions with the different distances from the heater formation surface S. Thus, a whirling flow occurs in the ink inside the bubbling chamber. The whirling flow disperses the debubbling position and thus the position impacted by the cavitation, in this case, the position of the heater. As a result, possible damage to the surface of the heater and possible disconnection can be prevented.

In the present embodiment, the substrate-side supply path 9 and the substrate far-side supply path 11 are formed to communicate with the bubbling chamber 10 at the position where the supply paths 9 and 11 lie opposite each other; the ink supply paths 30 extend opposite each other from the bubbling chamber 10. However, the present invention is not limited to this aspect. The ink supply paths extending from the bubbling chamber 10 need not necessarily communicate with the bubbling chamber 10 at the position where the supply paths lie opposite each other. When the bubbling chamber 10 is viewed in the ejection direction, the plurality of ink supply paths 30 have only to avoid extending, at the respective communication positions 34, in the same direction from the bubbling chamber 10. To allow the whirling current to occur inside the bubbling chamber 10, the ink supply paths 30 need to face in the different directions at the communication positions 34, where the ink supply paths communicate with the bubbling chamber 10. If the ink supply paths 30 extend in the same direction at the respective communication positions 34, where the ink supply paths communicate with the bubbling chamber 10, the flows of ink supplied to the bubbling chamber 10 through the ink supply paths 30 travel in the same direction. This prevents occurrence of the whirling flow.

Furthermore, even when the ink supply paths extend in the different directions at the communication positions 34, if the angles of the ink supply paths 30 as viewed in the ejection direction are small, the scale of a possible whirling flow is reduced. This makes the dispersion of the debubbling position difficult, and the occurrence of the cavitation may concentrate at a particular position. Thus, the directions in which the ink supply paths 30 extend at the respective communication positions 34, where the ink supply paths 30 communicate with the bubbling chamber 10, desirably have large angles. Further desirably, each of the communication positions 34, where the corresponding ink supply path 30 communicates with the bubbling chamber 10 is located opposite the bubbling chamber 10 so that the ink supply paths 30 extend opposite each other at the respective communication positions 34.

Second Embodiment

Now, a print head IJH' according to a second embodiment will be described with reference to FIGS. 6A to 6C. Components of the second embodiment which can be configured as is the case with the first embodiment are denoted by the same reference numerals in the figures and will not be described. Only differences from the first embodiment will be described.

In the first embodiment, the ink supply paths 30, that is, the substrate-side supply path 9 and the substrate far-side supply path 11, are formed such that one end of each ink supply path communicates with the bubbling chamber 10, whereas the other end of each ink supply path communicates with the common liquid chamber 35. In contrast, in the present embodiment, the two adjacent bubbling chambers 10 are arranged, and the substrate-side supply path 9 extends from each of the bubbling chambers 10. One end of the substrate-side supply path 9 communicates with the bubbling chamber 10 and the other end of the substrate-side supply path 9 communicates with the common liquid chamber 35. The substrate far-side supply path 11 is formed such that the other ends of the substrate far-side supply paths 11 extending from the adjacent bubbling chambers 10 communicate with each other. FIG. 6A shows a sectional view of the print head IJH' according to the second embodiment as viewed in the ejection direction. FIG. 6B shows a sectional view taken along line VIB-VIB in FIG. 6A.

In the present embodiment, the print head IJH' is formed such that the substrate-side supply path 9 communicates with the common liquid chamber 35 and such that the substrate far-side supply paths 11 communicate with each other. However, the present embodiment is not limited to this aspect. The print head IJH' may be formed such that the substrate far-side supply path 11 communicates with the common liquid chamber 35 and such that the substrate-side supply paths 9 communicate with each other. In the present embodiment, the number of channels coupled to and extending from the nozzle 5 is two. However, as shown in FIG. 6C, the channels extending from at least three nozzles may be coupled together so as to extend continuously.

Thus, the ink supply paths 30 extending from the adjacent bubbling chambers 10 may be formed such that one end of each of the ink supply paths 30 communicates with the corresponding bubbling chamber 10 and such that the other ends of the ink supply paths 30 communicate with each other.

Third Embodiment

Figure 7A:
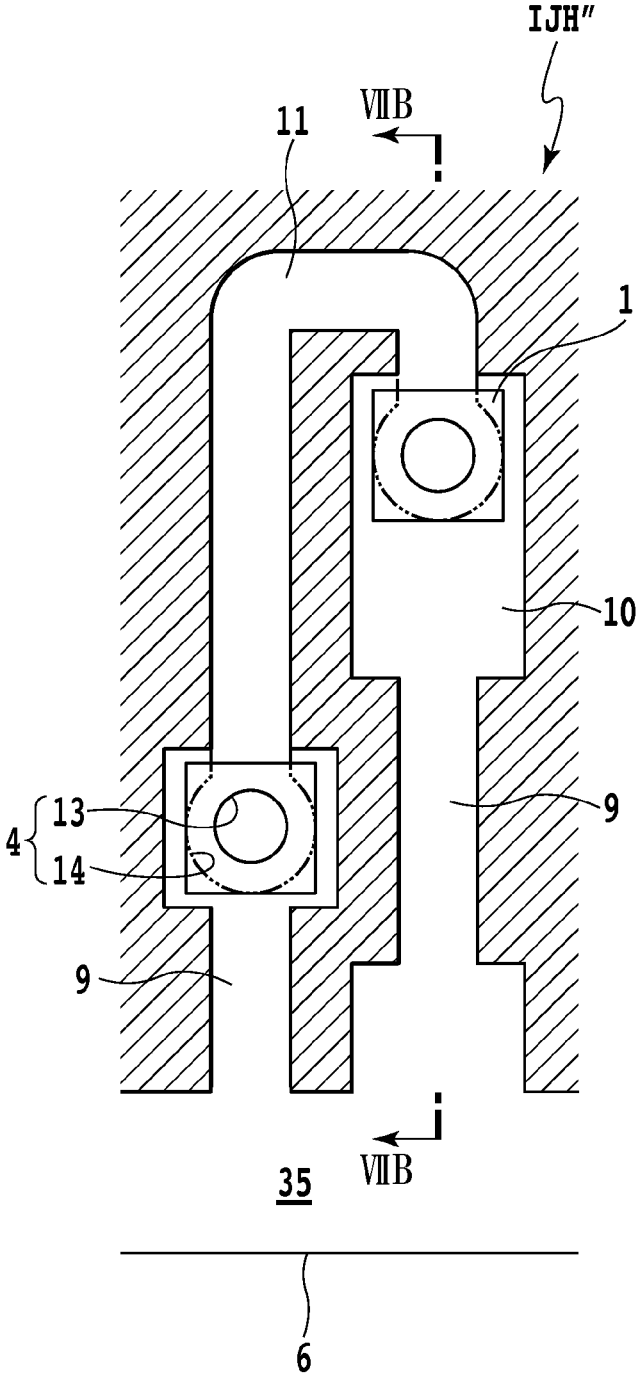
FIG. 7A is an enlarged sectional view of an essential part of a print head according to a third embodiment of the present invention as viewed in the ejection direction.
Figure 7B:
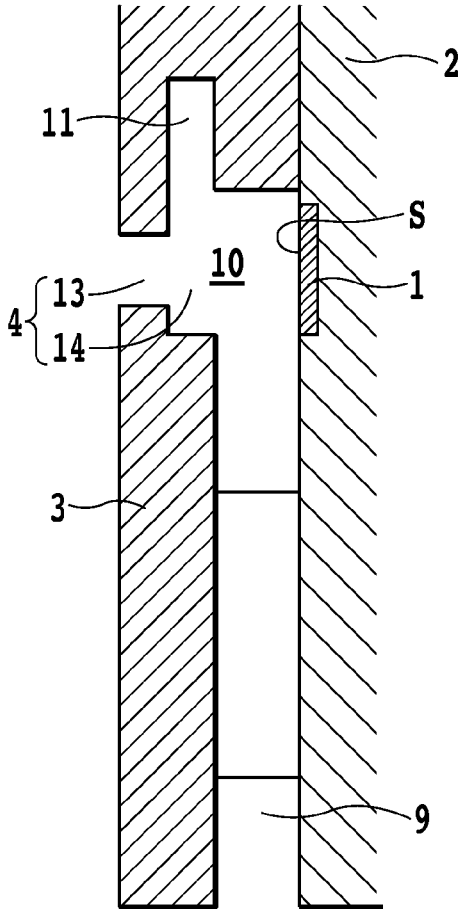
FIG. 7B is a sectional view of the essential part taken along line VIIB-VIIB in FIG. 7A.

Now, a print head IJH" according to a third embodiment will be described with reference to FIGS. 7A and 7B. Components of the third embodiment which can be configured as is the case with the first or second embodiment are denoted by the same reference numerals in the figures and will not be described. Only differences from the first or second embodiment will be described.

In the second embodiment, the ink supply paths 30 extending from the adjacent bubbling chambers 10 are formed such that one end of each of the substrate far-side supply paths 11 communicates with the corresponding bubbling chamber 10 and such that the other ends of the substrate far-side supply paths 11 communicate with each other. The adjacent bubbling chambers 10 are arranged at an equal distance from the ink supply port 6 through which ink is supplied to the bubbling chambers 10. In contrast, in the third embodiment, the adjacent bubbling chambers 10 are arranged at different distances from the ink supply port 6. FIG. 7A shows a sectional view of the print head IJH" according to the third embodiment as viewed in the ejection direction. FIG. 7B shows a sectional view taken along line VIIB-VIIB in FIG. 7A.

The above-described arrangement of the bubbling chambers allows the bubbling chambers 10, each of which requires a relatively large space, to be staggered. Thus, the bubbling chambers 10 can be densely formed in the print head IJH", which allows the ejection port portions 4 to be densely arranged. As a result, a print head with a high definition can be provided.

Fourth Embodiment

Now, a print head IJH'" according to a fourth embodiment will be described with reference to FIGS. 8A and 8B. Components of the fourth embodiment which can be configured as is the case with the first to third embodiments are denoted by the same reference numerals in the figures and will not be described. Only differences from the first to third embodiment will be described.

In the third embodiment, the ink supply paths extending from the adjacent bubbling chambers are such that one end of each of the ink supply paths communicates with the corresponding bubbling chamber and such that the other ends of the ink supply paths communicate directly with each other to form one ink supply path. Furthermore, the adjacent bubbling chambers are arranged at the different distances from the ink supply port. In contrast, in the fourth embodiment, an ink channel 12 for the substrate far-side supply path is formed opposite the side on which the common liquid chamber 35 is formed, across the bubbling chambers 10. The other ends of the ink supply paths 30 communicate with each other via a part of the ink channel 12 for the substrate far-side supply path. In the present embodiment, in particular, the other ends of the substrate far-side supply paths 11 are each connected to the ink channel 12 for the substrate far-side supply path. The ink channel 12 for the substrate far-side supply path extends in the same direction in which the ejection port row extends.

Figure 8A:
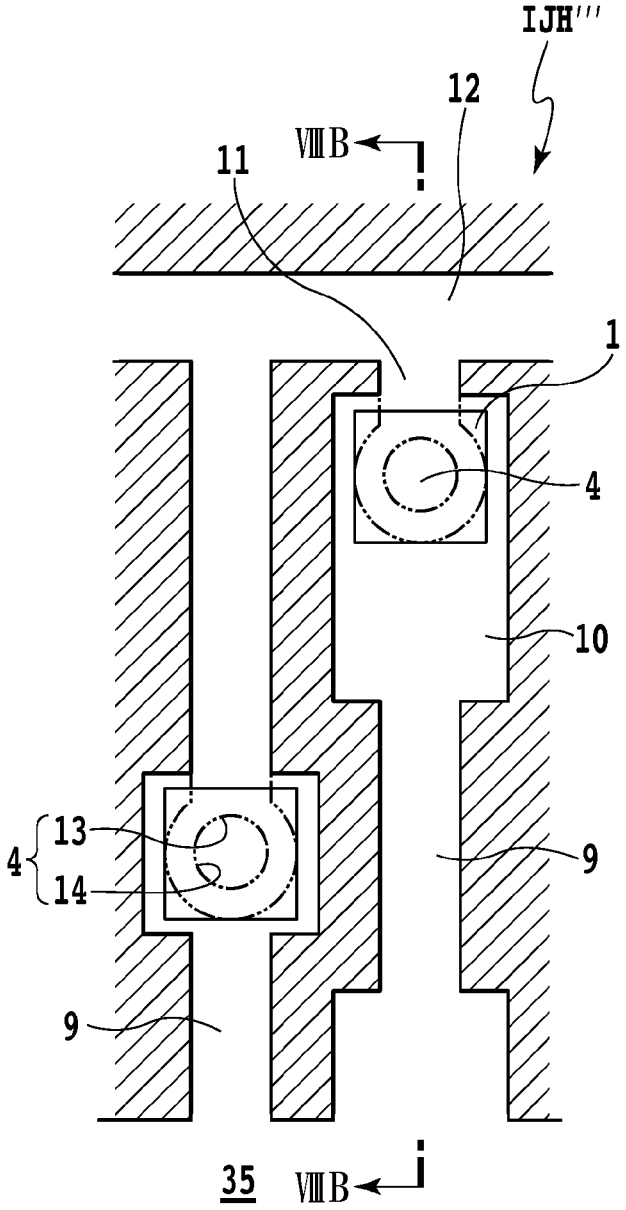
FIG. 8A is an enlarged sectional view of an essential part of a print head according to a fourth embodiment of the present invention as viewed in the ejection direction.
Figure 8B:
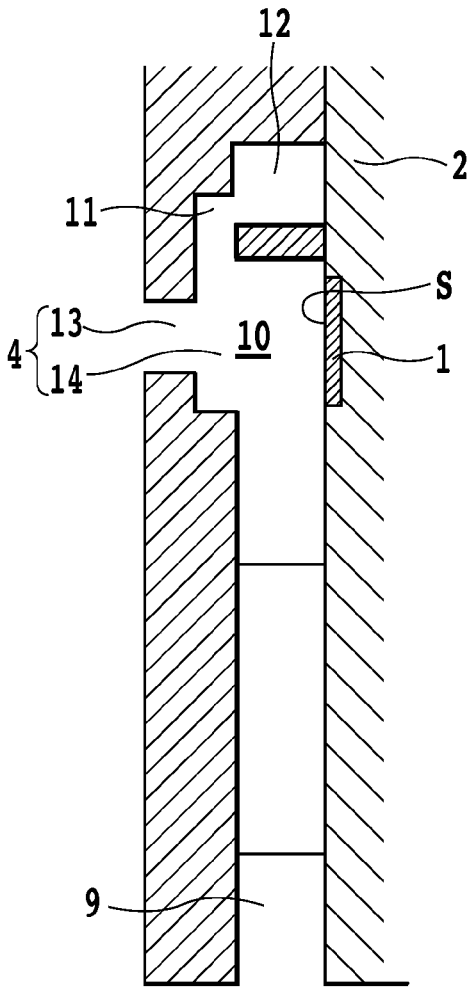
FIG. 8B is a sectional view of the essential part taken along line VIIIB-VIIIB in FIG. 8A.

FIG. 8A shows a sectional view of the print head IJH''' according to the fourth embodiment as viewed in the ejection direction. FIG. 8B shows a sectional view taken along line VIIIB-VIIIB in FIG. 8A. Thus, the adjacent bubbling chambers may be formed to communicate with each other via the ink channel instead of communicating directly with each other via the ink supply path.

Fifth Embodiment

Figure 9A:
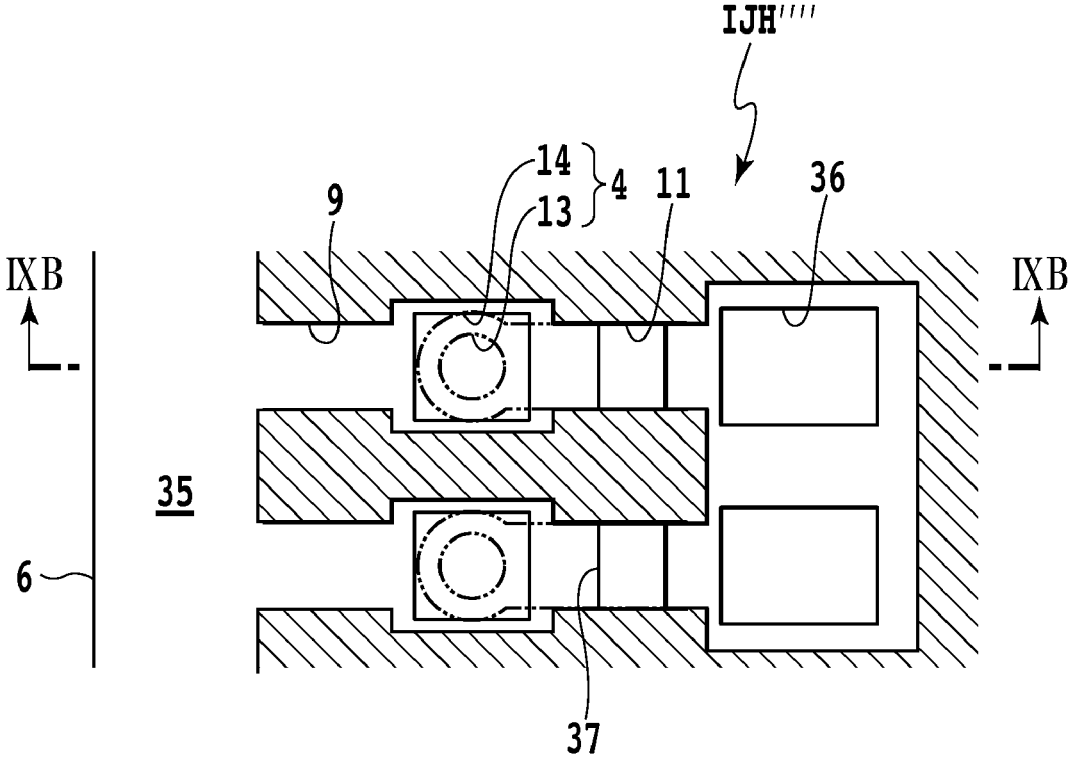
FIG. 9A is an enlarged sectional view of an essential part of a print head according to a fifth embodiment of the present invention as viewed in the ejection direction.
Figure 9B:
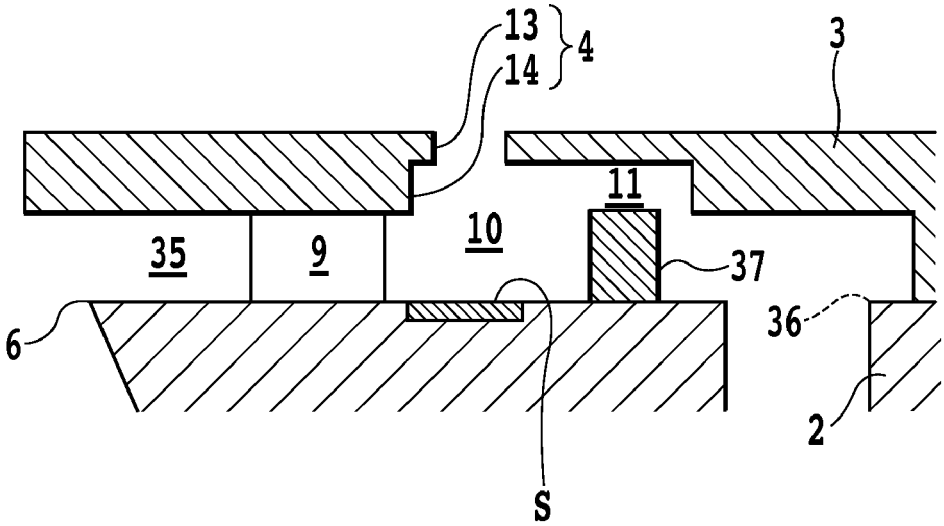
FIG. 9B is a sectional view of the essential part taken along line IXB-IXB in FIG. 9A.

Now, a print head IJH'''' according to a fifth embodiment will be described with reference to FIGS. 9A and 9B. Components of the fifth embodiment which can be configured as is the case with the first to fourth embodiments are denoted by the same reference numerals in the figures and will not be described. Only differences from the first to fourth embodiment will be described.

In the first embodiment, the print head is formed such that the bubbling chamber 10 is formed between the adjacent common liquid chambers 35 and such that the substrate-side supply path 9 and substrate far-side supply path 11, which communicate with each of the common liquid chambers 35, communicate with the bubbling chamber 10. In the second to fourth embodiments, the print head is formed such that the adjacent substrate-side supply paths 9 or substrate far-side supply paths 11 extending from the common liquid chambers 35 communicate with each other. In contrast, in the present embodiment, an independent supply port 36 is formed opposite the common liquid chamber 35 across the bubble chamber 10, in association with the nozzle 5. In particular, in the present embodiment, a plurality of the independent supply ports 36 through which ink is supplied to the bubbling chamber 10, is formed for each nozzle 5. One end of each of the substrate far-side supply paths communicates with the corresponding bubbling chamber 10 and the other end of the substrate far-side supply path communicates with the corresponding independent supply port 36. The print head IJH'''' is formed as described above. Furthermore, in the present embodiment, the substrate far-side supply path 11 is formed by placing a nozzle material 37 at a position where the substrate far-side supply path 11 communicates with the bubbling chamber 10. The adjacent independent supply ports 36 are formed to communicate with each other so that the substrate far-side supply paths 11 communicate with each other. FIG. 9A shows a sectional view of the print head IJH'''' according to the fifth embodiment as viewed in the ejection direction. FIG. 9B shows a sectional view taken along line IXB-IXB in FIG. 9A.

In the present embodiment, the print head is formed such that each of the substrate far-side supply paths 11 communicates with the corresponding independent supply port 36. However, the present embodiment is not limited to this aspect. The print head may be formed such that the substrate-side supply path 9 communicates with the independent supply port 36, whereas the substrate far-side supply port 11 communicates with the common liquid chamber 35. Furthermore, the substrate far-side supply path 11 need not be formed by placing the nozzle material 37 but may be formed by alternatives, for example, based on the shape of the orifice plate 3. Moreover, in the present embodiment, the independent supply ports 36 are formed in association with each nozzle 5. However, the independent supply ports 36 may be shared by a plurality of the nozzles 5 such that ink is supplied to the nozzles 5 through the independent supply ports 36.

Sixth Embodiment

Figure 10A:
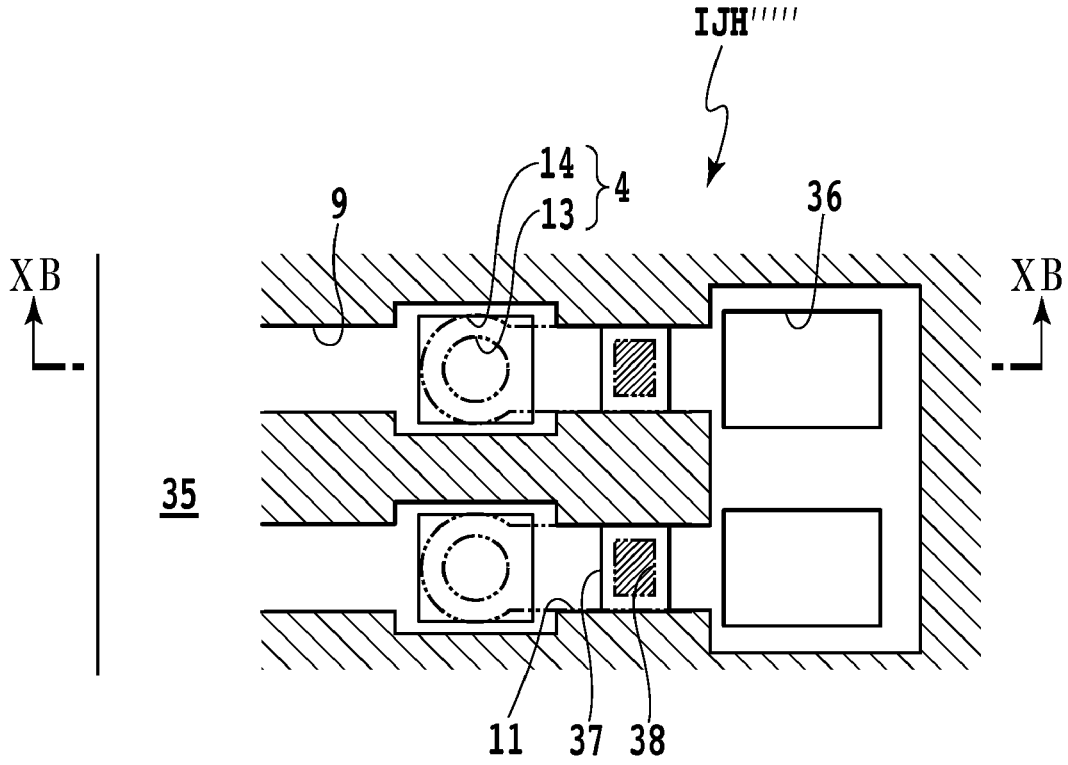
FIG. 10A is an enlarged sectional view of an essential part of a print head according to a sixth embodiment of the present invention as viewed in the ejection direction.
Figure 10B:
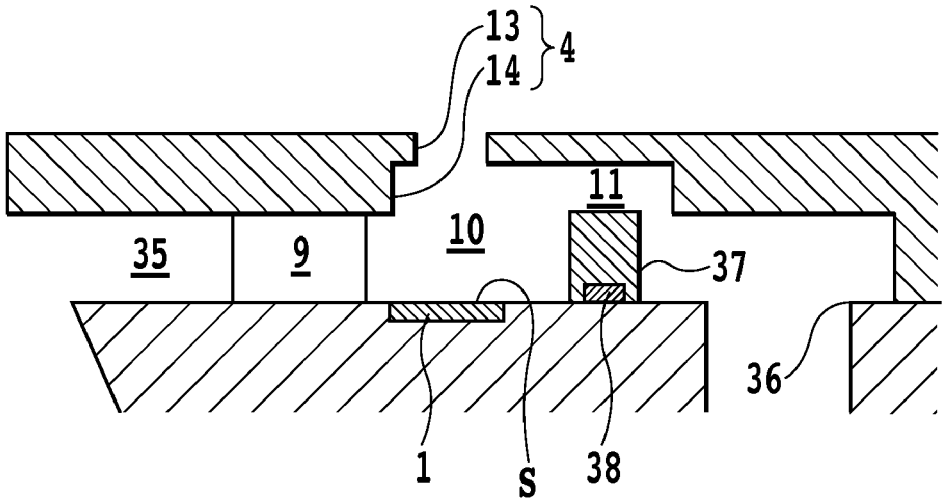
FIG. 10B is a sectional view of the essential part taken along line XB-XB in FIG. 10A.

Now, a print head IJH''''' according to a sixth embodiment will be described with reference to FIGS. 10A and 10B. Components of the sixth embodiment which can be configured as is the case with the first to fifth embodiments are denoted by the same reference numerals in the figures and will not be described. Only differences from the first to fifth embodiment will be described.

In the fifth embodiment, the independent supply ports 36 are formed opposite the common liquid chamber 35 in association with the nozzle 5. One end of each of the substrate far-side supply paths 11 communicates with the corresponding bubbling chamber 10 and the other end of the substrate far-side supply path 11 communicates with the corresponding independent supply port 36. The print head is formed as described above. Moreover, the substrate far-side supply path 11 is formed by placing the nozzle material 37 at the position where the substrate far-side supply path 11 communicates with the bubbling chamber 10. In contrast, the present embodiment differs from the fifth embodiment in that a through-hole 38 is formed inside the nozzle material 37 and in that a wire is passed through the through-hole 38. The wire may be used to transmit the electric signal to the heater 1. Since the wire is passed through the through-hole 38, formed inside the nozzle material 37, a space in which the wire is placed can be efficiently provided inside the nozzle material 37. The print head can correspondingly be made compact. FIG. 10A shows a sectional view of the print head IJH''''' according to the sixth embodiment as viewed in the ejection direction. FIG. 10B shows a sectional view taken along line XB-XB in FIG. 10A.

In the present embodiment, the through-hole 38 extends through the nozzle material 37. Thus, if this arrangement is applied to the conventional print head, possible cavitation may cause an impact, which may break the wire passed through the through-hole 38. However, in the present embodiment, the distance from the element substrate 2 to the position where the substrate-side supply path 9 communicates with the bubbling chamber 10 differs from that from the element substrate 2 to the position where the substrate far-side supply path 11 communicates with the bubbling chamber 10. This results in the whirling flow of the ink, which prevents the debubbling position from being fixed. Therefore, the possible cavitation is inhibited from concentrating at one position. Thus, the nozzle material 37 is also unlikely to be damaged by the impact of repeated cavitation. Furthermore, the wire passed through the through-hole 38 inside the nozzle material 37 is unlikely to be broken. Additionally, the wire is coated with the nozzle material 37 to increase the strength of the wire. This is also effective for inhibiting a possible situation in which the coating material of the wire is extensively damaged and exposed by the cavitation, resulting in an electric short circuit in the through-hole portion. Thus, the print head IJH''''' according to the present embodiment allows the wire passed through the through-hole 38 to be inhibited from being broken or short-circuited.

Seventh Embodiment

Figure 11A:
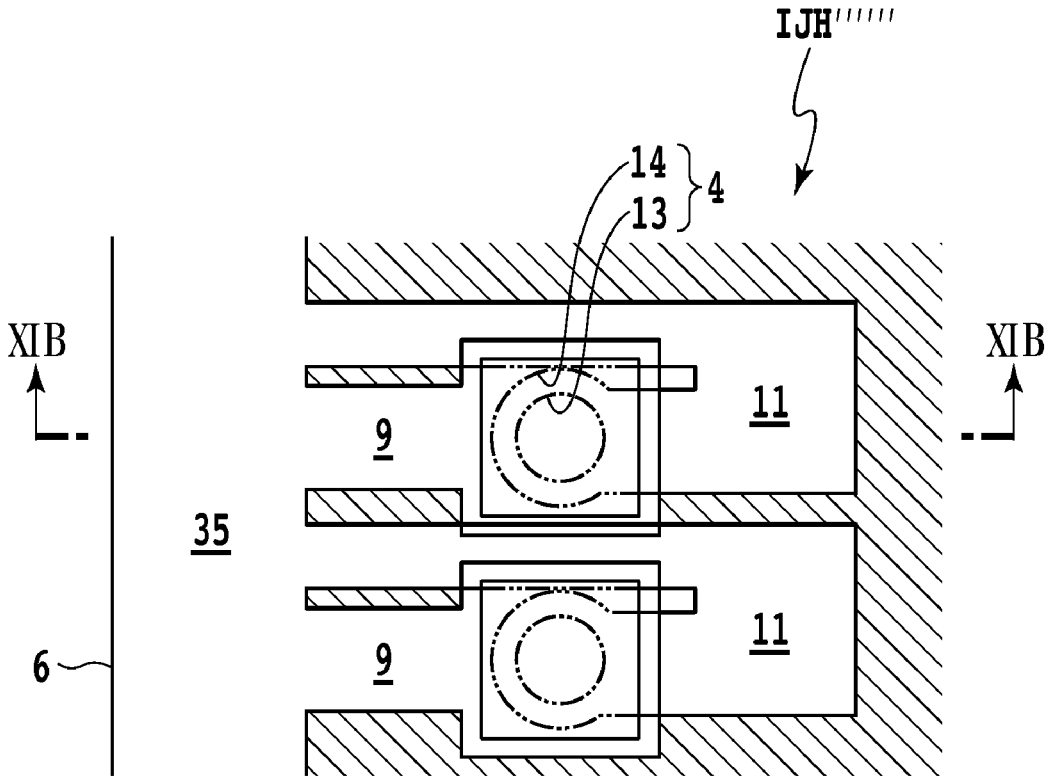
FIG. 11A is an enlarged sectional view of an essential part of a print head according to a seventh embodiment of the present invention as viewed in the ejection direction.
Figure 11B:
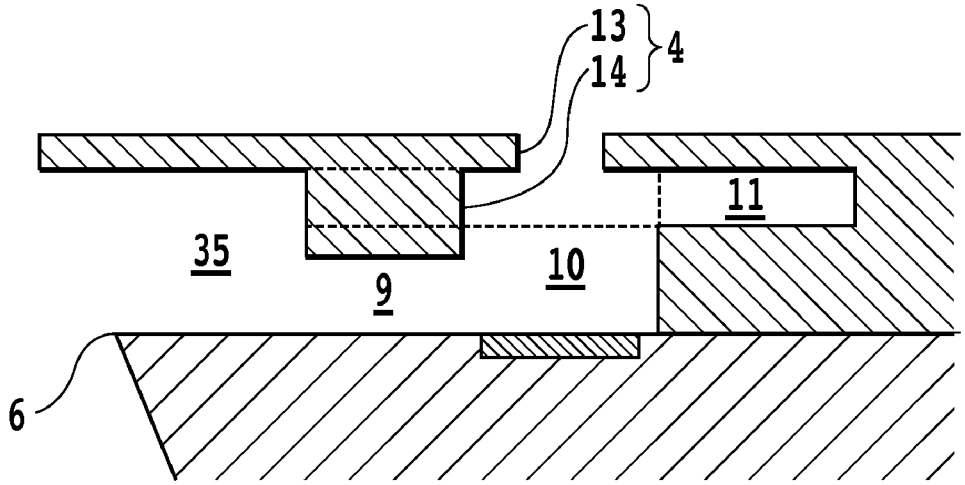
FIG. 11B is a sectional view of the essential part taken along line XIB-XIB in FIG. 11A.

Now, a print head IJH'''''' according to a seventh embodiment will be described with reference to FIGS. 11A and 11B. Components of the seventh embodiment which can be configured as is the case with the first to sixth embodiments are denoted by the same reference numerals in the figures and will not be described. Only differences from the first to sixth embodiment will be described.

In the first embodiment, the print head is formed such that the bubbling chamber 10 is formed between the adjacent common liquid chambers 35 and such that the substrate-side supply path 9 and substrate far-side supply path 11, which communicate respectively with each of the common liquid chambers 35, communicate with the bubbling chamber 10. In contrast, in the present embodiment, one end of the substrate-side supply path 9 communicates with the bubbling chamber 10, and the other end communicates with the common liquid chamber 35. Furthermore, the substrate far-side supply path 11 extending from the bubbling chamber 10 is looped back so that the other end of the substrate far-side supply path 11 communicates with the common liquid chamber 35, with which the substrate-side supply path 9 communicates. FIG. 11A shows a sectional view of the print head IJH"""" according to the seventh embodiment as viewed in the ejection direction. FIG. 11B shows a sectional view taken along line XIB-XIB in FIG. 11A. In this manner, both the substrate-side supply path 9 and the substrate far-side supply path 11 may communicate with the same common liquid chamber 35.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-315034, filed Dec. 5, 2007, which is hereby incorporated by reference herein in its entirety.

What is claimed is:

1. A liquid ejection head comprising:

a substrate;

a heating element disposed on the substrate to generate heat energy utilized to eject a liquid;

an energy acting chamber partly defined by the substrate and in which the heating element is disposed; and an ejection port portion provided opposite the heating element to eject the liquid contained in the energy acting chamber to which the heat energy is applied by the heating element, wherein plural liquid supply paths through which the liquid is supplied to the energy acting chamber are connected to the energy acting chamber, and communication positions where the plural liquid supply paths communicate with the energy acting chamber are formed such that distances from a heating element formation surface to each of the communication positions are different from each other along a direction orthogonal to the heating element formation surface.

2. The liquid ejection head according to claim 1, wherein when the energy acting chamber is viewed in an ejection direction in which the liquid is ejected, the plural supply paths do not extend, at the communication positions, in the same direction from the energy acting chamber.

3. The liquid ejection head according to claim 1, wherein the two liquid supply paths communicate with the energy acting chamber, and a distance from the heating element formation surface to one of two communication positions differs from a distance from the heating element formation surface to the other communication position.

4. The liquid ejection head according to claim 3, wherein when the energy acting chamber is viewed in the ejection direction in which the liquid is ejected, the two supply paths extend, at the communication positions, in opposite directions via the energy acting chamber.

5. The liquid ejection head according to claim 3, wherein the ejection port portion includes a first ejection port portion communicating with atmosphere, and a second ejection port portion with a larger sectional area than the first ejection port portion in a direction orthogonal to the ejection direction, the second ejection port portion being formed between the energy acting chamber and the first ejection port portion, and the liquid supply path with the farther distance from the heating element formation surface to the communication position communicates with the second ejection port portion.

6. A printing apparatus performing printing using a liquid ejection head comprising:

a substrate;

a heating element disposed on the substrate to generate heat energy utilized to eject a liquid;

an energy acting chamber partly defined by the substrate and in which the heating element is disposed; and an ejection port portion provided opposite the heating element to eject the liquid contained in the energy acting chamber to which the heat energy is applied by the heating element, wherein plural liquid supply paths through which the liquid is supplied to the energy acting chamber are connected to the energy acting chamber, and communication positions where the plural liquid supply paths communicate with the energy acting chamber are formed such that distances from a heating element formation surface to each of the communication positions are different from each other along a direction orthogonal to the heating element formation surface.

* * * * *